US005306882A

United States Patent [19]

Gerwing et al.

[11] Patent Number: 5,306,882

[45] Date of Patent: * Apr. 26, 1994

[54] MEASURING ELEVATOR HOISTWAY POSITION USING AUDIBLE SIGNALS

[75] Inventors: Axel S. Gerwing; Lutz Vietze; Claudia M. Schmidt-Milkau, all of Berlin, Fed. Rep. of Germany

[73] Assignee: Otis Elevator Company, Farmington, Conn.

[ * ] Notice: The portion of the term of this patent subsequent to Jun. 29, 2010 has been disclaimed.

[21] Appl. No.: 708,946

[22] Filed: May 13, 1991

[51] Int. Cl.[5] ..... B66B 3/02

[52] U.S. Cl. ..... 187/134; 367/127

[58] Field of Search ..... 187/132, 134, 104, 105, 187/107; 367/93, 5, 117, 127; 340/1

[56] References Cited

U.S. PATENT DOCUMENTS 3,098,992 7/1963 Rath ..... 367/6

4,055,830 10/1977 Wilson et al. ..... 367/128

4,313,183 1/1982 Saylors ..... 367/128

*Primary Examiner*—Steven L. Stephan

*Assistant Examiner*—Robert Nappi

*Attorney, Agent, or Firm*—Breffni X. Baggot

[57] ABSTRACT

A microphone 13 is provided upon the ceiling 4 of an elevator hoistway 3 and a loudspeaker 8 upon the top of an elevator car 1. A 9–16 kHz up-sweep is provided to the loudspeaker 8 and a sound signal is transmitted from the loudspeaker 8 to the microphone 13. The travel time of the sound signal is obtained by cross-correlating 53 the sound signal received by the microphone 13 with a reference signal. The reference signal is a received signal in a relatively noiseless environment. By multiplying the travel time of the signal by its velocity, the distance between microphone and loudspeaker is calculated 59. The hoistway temperature is measured 26 and used 57 in the absolute position calculation 59.

10 Claims, 5 Drawing Sheets

ANALOG SIGNAL RECEIVED AFTER START-TRIGGER

MEASURING ELEVATOR HOISTWAY POSITION USING AUDIBLE SIGNALS

TECHNICAL FIELD

This invention relates to measurement of absolute elevator position, and particularly, using sound.

BACKGROUND OF THE INVENTION

In general, encoders at the drive shaft, on the one hand, and additional vanes and sensors in the hoistway, on the other hand, are used to detect absolute car position. In an emergency affecting the power source, the absolute position information can be written into an EEPROM or battery backed-up RAM to avoid the loss of that information. However, if the car moves independently of the elevator drive after the power supply has failed, or after getting the last absolute position signal, actual car position is lost. In such a case, after connecting to the line voltage, the absolute car position is usually obtained by means of an initialization run. U.S. Pat. No. 4,341,287 shows such a system. In other applications, multi-channel encoders are coupled to the car by a steel tape, holed or having magnets placed thereon, and the pulse train signals from the encoder are transformed to absolute position information. The absolute position initialization is accomplished by moving the car a few centimeters. Other prior art arrangements use coded indicia in the hoistway and appropriate readers of the indicia on the car or batteries for powering the absolute car position memory circuits during a power outage.

It would be desirable to determine the absolute car position, without requiring the car to move to a predetermined initialization floor, without requiring coded indicia in the hoistway and code readers on the car, and without requiring batteries or other auxiliary power supplies for storing the absolute position the car had before power failure.

There is a wide range of requirements for absolute position indicators, but not every requirement must be fulfilled. For instance, in cases of an emergency, it is enough to know the approximate location of the car. In order to get the absolute car position directly, the absolute position sensor should be located in the hoistway. This requires a sensor system, which is insensitive to dust and acoustical interferences. For this reason, optical methods, such as infrared and laser, are unacceptable. Optical sensors are sensitive to dust because the light intensity decreases where a layer of dust appears on the lens or reflector. In addition, there is a need of regular maintenance which increases costs.

An absolute position measuring system with ultrasonic sensors offering the advantage of being usable in dusty environments such as hoistways is described in co-pending application Ser. No. 07/709,796, a continuation-in-part of Ser. No. 07/695,364, "Static Measuring of Elevator Car Position", by C. Schmidt-Milkau, K. Disterer, and R. E. Hanitsch, and assigned to Otis Elevator Company.

A problem with acoustic methods is echoes. As all echoes have the same frequency and intensity as the direct signal, differentiating between direct signals and echoes is difficult. Where two transducers are used, a first transducer and a responding transducer, there are usually two types of echoes: near-echoes and far-echoes. Near-echoes distort measurements at the first transducer; far-echoes distort measurements at the responding transducer. Near-echoes can produce a signal which would indicate the end of the measurement. They do this by hitting some object and rebounding onto to the first transducer before the responding transducer responds with a signal. The length of the path followed by the near-echo may vary, especially with the cross-sectional area of the hoistway.

Far-echoes are acoustic signals emitted from the first transducer and, rather than proceeding directly to the responding transducer, hit the walls and then the responding transducer. Because these signals do not travel the shortest distance between the two transducers, measuring them can only distort the distance measurement. The length of the path followed by the far-echo may vary, especially with the crosssectional area of the hoistway and the vertical distance between the transmitting transducer and the responding transducer.

One method of dealing with this problem is disclosed in "Measuring Elevator Car Position Using Ultrasound" assigned to the same assignee as the present invention Ser. No. 07/709,796, a continuation-in-part of Ser. No. 07/695,364, by C. Schmidt-Milkau, K. Disterer, and R. E. Hanitsch. Two ultrasonic transducers are provided for measuring absolute position, one upon the ceiling of an elevator hoistway, and the other on top of an elevator car. In addition, two delay elements are provided. A start signal initiates the absolute position measurement and causes a first ultrasonic signal to be transmitted from the ceiling transducer to the car transducer. After receipt of the first ultrasonic signal by the car transducer and a far-echo delay for avoiding ultrasonic echoes from the hoistway walls and hoist ropes, a second ultrasonic signal of the same amplitude and frequency is transmitted from the car transducer to the ceiling transducer. The ceiling transducer receives the second ultrasonic signal and provides a stop signal. A delay element prevents the stop signal from reaching a timer until the end of a selectable time period. The timer, responsive to start and stop signals measures the travel time of the ultrasonic signals. The multiplication of the travel time of the signals with their velocity, and use of the two echo-avoiding delays, yields the car's absolute position while at the same time avoiding echoes.

A disadvantage of all ultrasonic measuring methods is the limited working distance due to the high damping in air of sound or ultrasonic waves. Their use is restricted to low-rise elevators. The damping in air is equivalent to $[1.17\times10^{-4}\,(\text{frequency/kHz})^2]$ dB/meter at 25° Celsius.

A disadvantage of the ultrasonic measuring system above is the need for an echo-avoiding system.

It is desirable to measure absolute elevator position with sound at distances of more than 100 meters. It is further desirable to accomplish this without the need for an echo-avoiding system.

SUMMARY OF THE INVENTION

According to the present invention, a microphone is provided upon the ceiling of an elevator hoistway and a loudspeaker upon the top of an elevator car. A 9–16 kHz upsweep is provided to the loudspeaker and a sound signal is transmitted from the loudspeaker to the microphone. The travel time of the sound signal is obtained by cross-correlating the sound signal received by the microphone with a reference signal. The reference signal is a received signal in a relatively noiseless environment. By multiplying the travel time of sound by its velocity, the distance between the microphone and loudspeaker is calculated. In further accord with t present invention, the hoistway temperature is measured and used in the absolute position calculation.

It is an object of the present invention to determine the distance between an end of a hoistway and an elevator car.

It is a second object of the present invention to determine the absolute car position after a power loss using sound.

It is a third object of the present invention to obtain the distance between an end of a hoistway and an elevator car before the first run after a power loss without the need for an initialization run.

It is a fourth object of the present invention to provide a measuring system which is operable for the full length of a hoistway of at least 100 m.

It is a fifth object or the invention to measure the distance between an end of a hoistway and an elevator car using an intelligent acoustic measuring method: (i) using a microprocessor; (ii) using a reference measurement as feedback; (iii) using a temperature measurement of the hoistway as feedback; and (iv) altering the gain of the receiving section in response to travel time fed back from a previous measurement, thus using a total of three feedback elements.

It is a seventh object of the invention to avoid the effects of the movement of cars in adjacent hoistways by using a direct measurement process, rather than a pulse-echo measurement process.

These and other objects, features and advantages of the present invention will become more apparent in light of the following detailed description of the invention, as illustrated in the accompanying drawings.

BRIEF DESCRIPTION OF THE DRAWINGS

FIGS. 4–7 are on a common time line.

FIG. 5 shows a cross-correlation, $R_{sn_{sr}}$(nT), on a time v. volts$^2$ curve, of the received signal and an undisturbed reference signal.

FIG. 6 shows the extremums, $F_{extr}$(nT), on a time v. volts$^2$ curve, taken of the cross-correlation function, $R_{sn_{sr}}$n(T)

FIG. 7 shows, on a time v. volts$^2$ curve, the envelope of the extremums, $F_{extr}$(nT), cross-correlation function, $R_{sn_{sr}}$n(T)

DETAILED DESCRIPTION OF THE INVENTION

Figure 1:
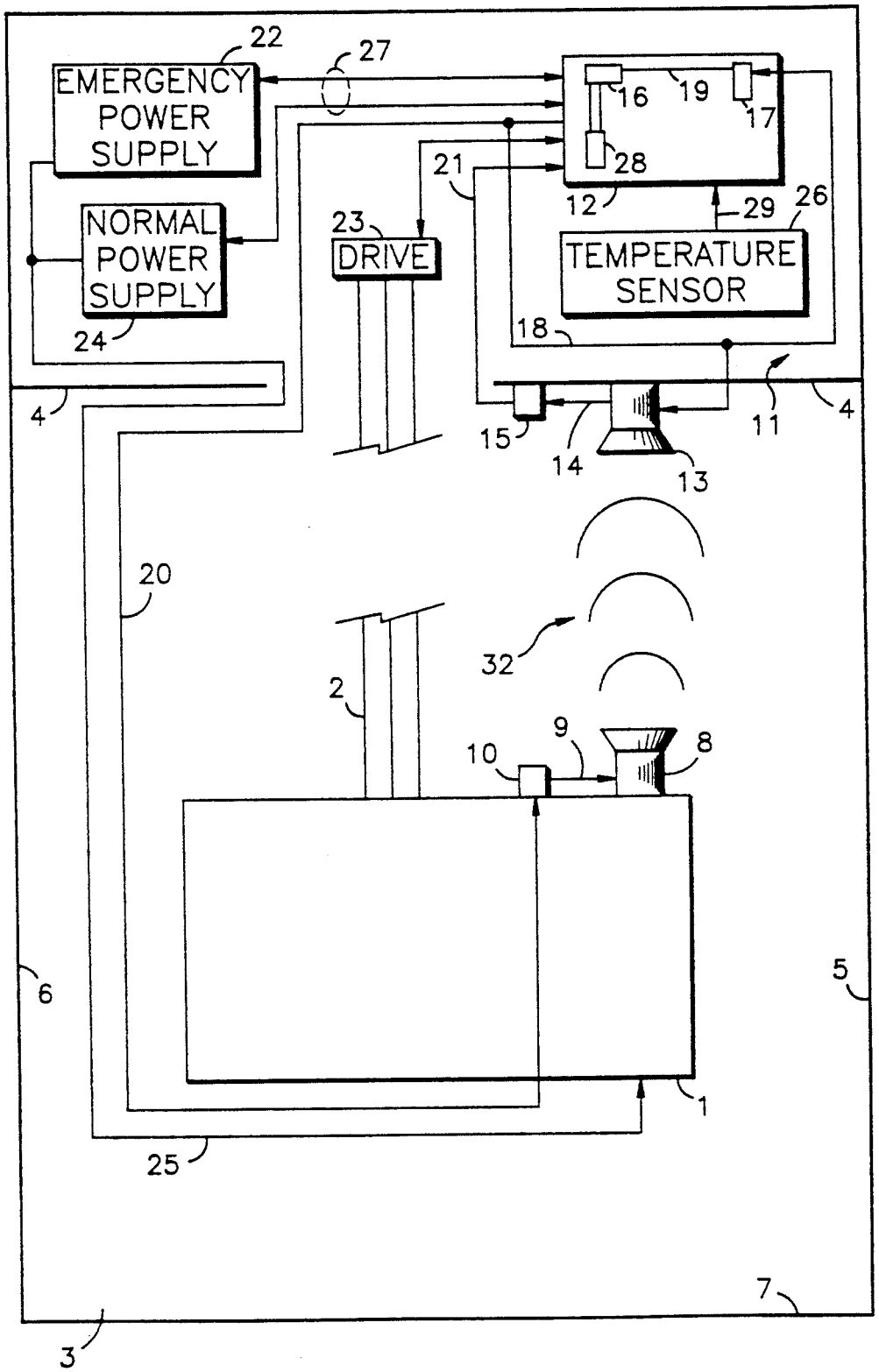
FIG. 1 shows a schematic front-elevational view of an elevator car 1 in a hoistway 3.

In FIG. 1, an elevator car 1 is suspended from ropes 2 in a hoistway 3 having a ceiling 4, walls 5, 6, and a floor 7. Mounted on the ceiling 4 is a microphone 13 for receiving a sound signal and providing an analog signal on a line 14 and receiving circuit 15. In the machine room 11 is an elevator controller 12 with a CPU 16. A receiving timer 17 receives a trigger signal on a line 18 in the controller 12 and provides a receiving time signal on a line 19 to CPU 16. Mounted upon the roof of the car 1 is a loudspeaker 8. Both the loudspeaker 8 and the microphone 13 are located between the wall 5 and the ropes 2. Electrically connected to the loudspeaker 8 on a line 9 is a transmitting circuit 10. The controller 12 is connected to the transmitting circuit 10 on a line 20 and to the receiving circuit 15 on a line 21. The purpose of the receiving timer 17 is to measure the time during which the microphone 13 may receive the sound signal 32. Later this time is used to determine when the received signal may be analyzed.

In the preferred embodiment, the loudspeaker 8 is a voltage-to-pressure device and uses a wide frequency range of 100 dB (within a distance of 1½ m. of the loudspeaker) between 9 and 16 kHz.

Power for the loudspeaker 8 is taken from an emergency power supply 22 which also provides power to the car 1 and a drive 23. The emergency power supply 22 is operable when a normal power supply 24 fails. Power to the car from either supply is via a traveling cable 25. All circuit elements may be powered from either supply. Control of the normal and emergency power supplies is through pair of lines 27. The controller 12 is responsive to a temperature measurement from a temperature sensor 26 on a line 29.

The measurement process is begun with a start signal on a line 20 and ended when the response signal on a line 21 is presented to a time and distance detection section 28 in the controller 12. The loudspeaker 8 sends a sound signal 32 to the microphone 13, and the time and distance detection circuit 28 calculates the distance between the microphone 13 and loudspeaker 8 by multiplying the travel time of the sound signal by the magnitude of its velocity.

Figure 2:
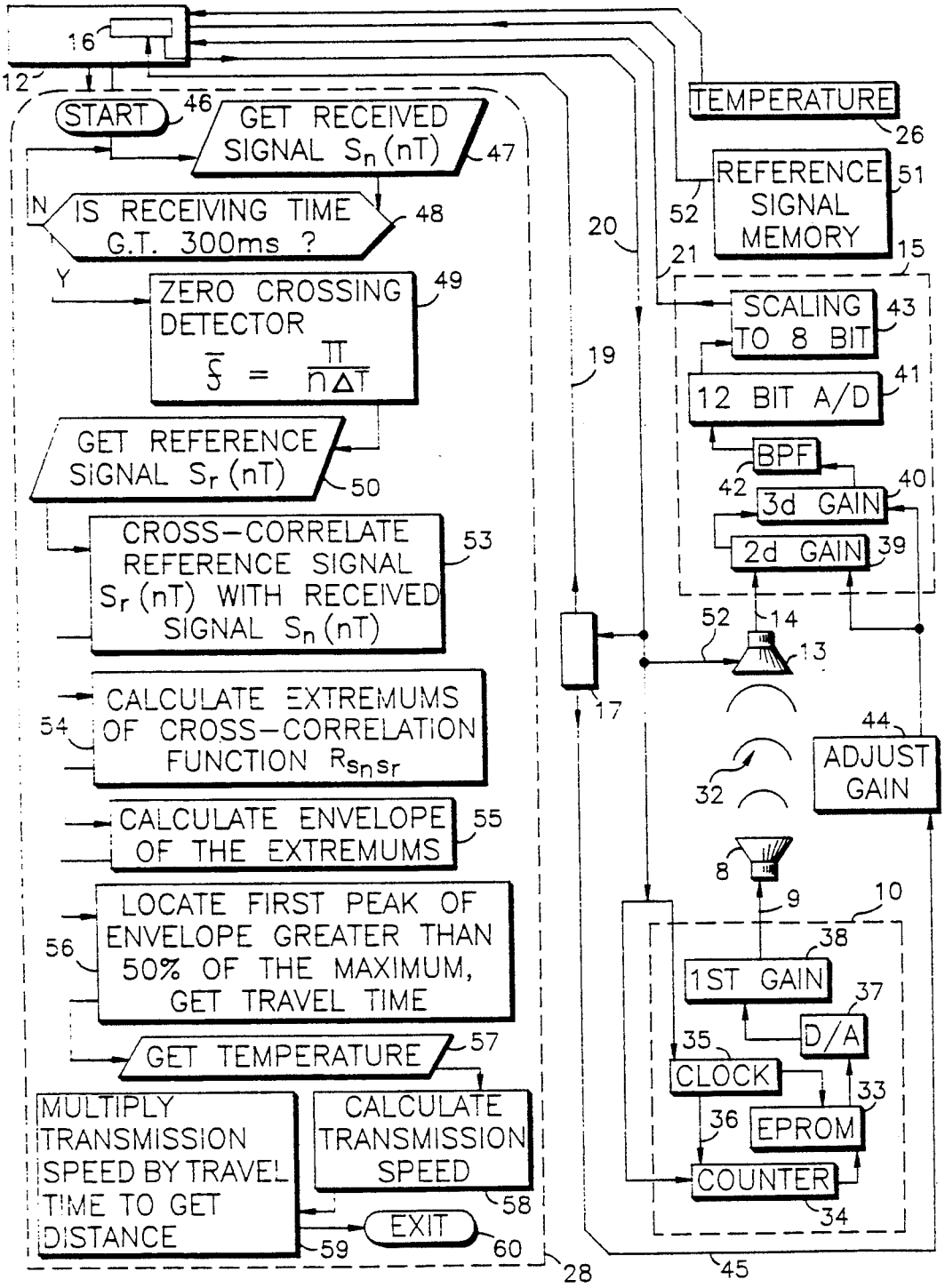
FIG. 2 shows a loudspeaker 8, microphone 13, and time and distance detection section 28.

FIG. 2 shows a transmitting circuit 10, a receiving circuit 15, and time and distance detection section 28 residing in software in the car controller 12. An EPROM 33 contains the digital exciting signal with which to excite the loudspeaker 8. In response to the trigger signal on line 20, a counter 34, together with a clock 35, reads the exciting signal out of the EPROM 33. The measurement begins when the trigger signal is provided on line 20 from the controller 12 to the transmitting circuit 10. In response to receiving the trigger signal, the counter 34 is enabled to receive clock pulses on a line 36 from the clock 35. The counter 34 counts the clock pulses up to a limit, proportional to 4.5 milliseconds. When 4.5 ms is reached, the EPROM 33 is disabled, and the clock frequency is 100 kHz. The clock pulses are provided to the EPROM 33 allowing it to read out 100 data values per second. Thus, the counter 34 limits the duration of the exciting signal from the EPROM 33 to 4.5 ms. After the digital exciting signal is read out by counter 34 and clock 35, converted to analog form in a d/a converter 37, and amplified in a first gain section 38, an analog exciting signal is provided to the loudspeaker 8 from the first gain 38.

The exciting signal up-sweep is chosen between 9 kHz and 16 kHz because 8 kHz is the noise limit with the main portion being at 3–4 kHz; varying range, that is, a sweep, eliminates the chance that a noise signal at a particular frequency will be able to distort the measurement. 16 kHz is the limit above which damping of acoustic waves begins to become significant; we take a continuous combination of frequencies, because if we did not, we would not be able to tell the difference between noise and the signal, and further, a disturbed signal consisting of the direct signal plus noise will not have a 9–16 kHz up-sweep. An up-sweep is chosen over a down-sweep because the 9 kHz signal has a higher energy than a 16 kHz signal. Since the tweeter will work better when precharged, the sound signal will be transferred better.

Figure 3:
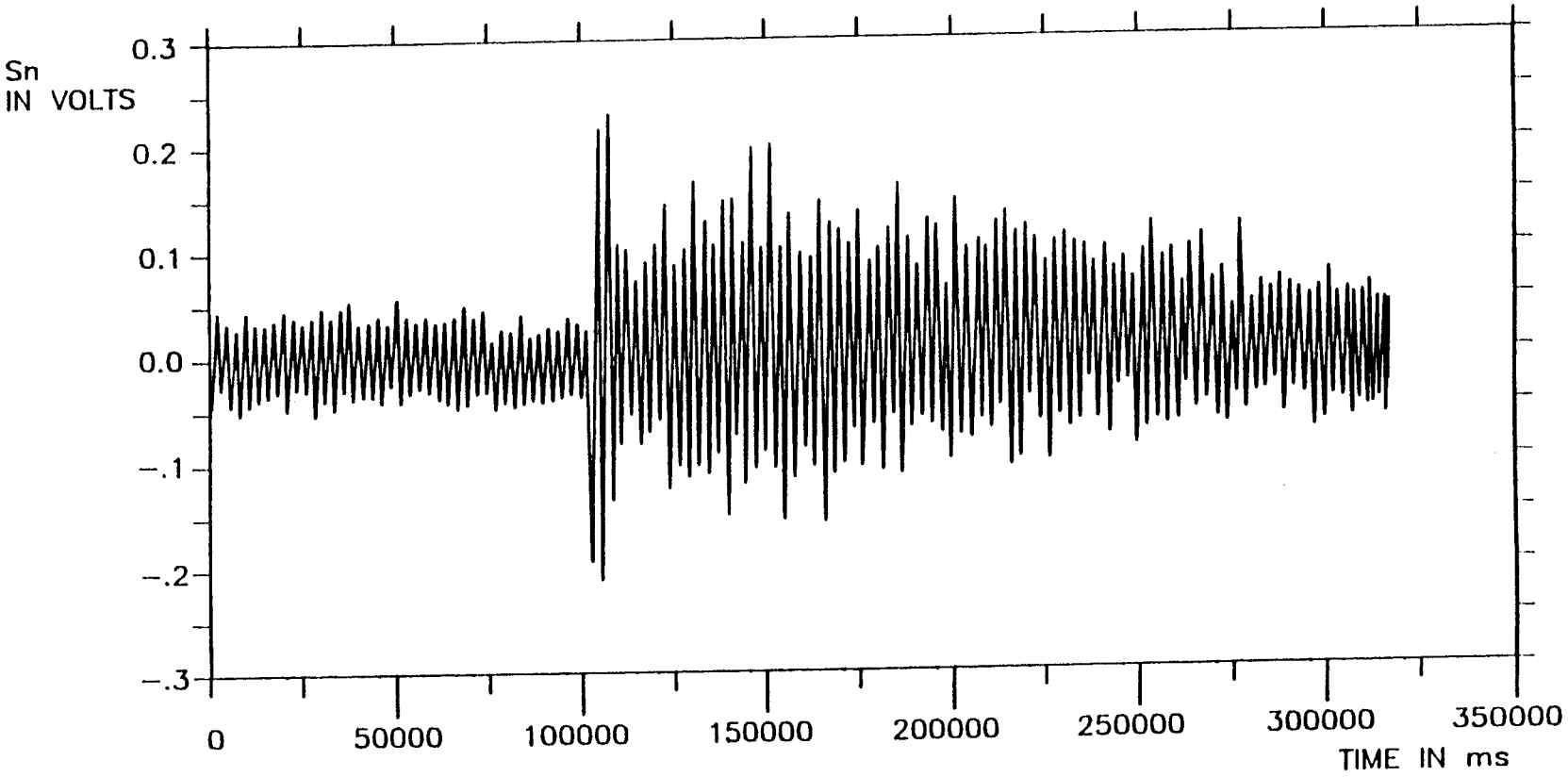
FIG. 3 is a graph of the analog signal $S_n$t provided by the microphone 13.
Figure 4:
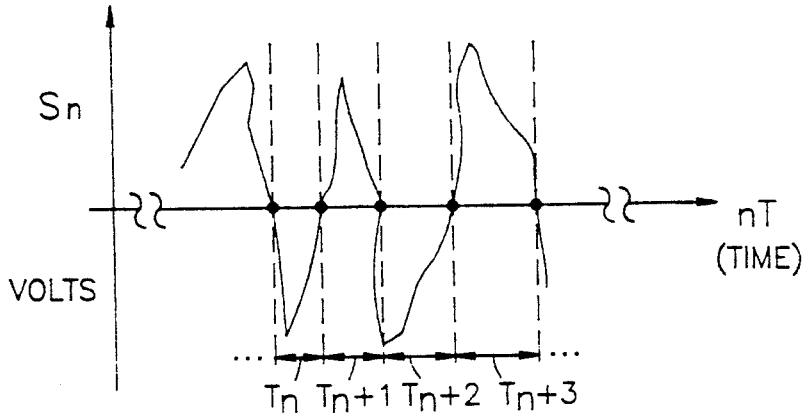
FIG. 4 shows a digital signal, $S_n$(nT), of the analog signal $S_n$(t) received at the microphone on a time v. volts curve, the origin coinciding with the trigger signal.
Figure 5:
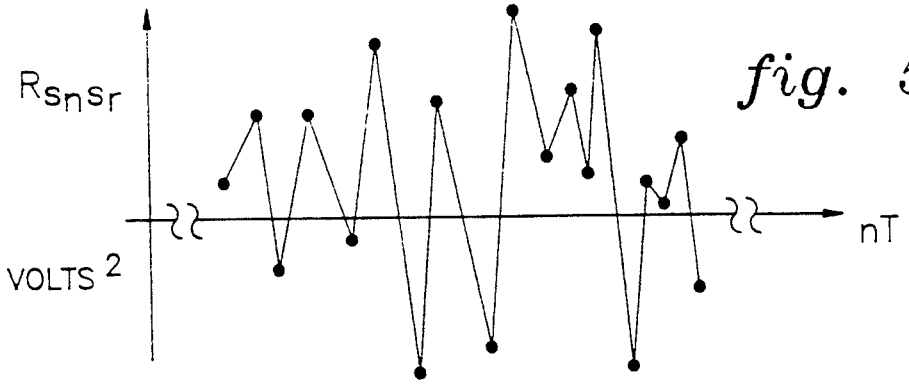
Figure 6:
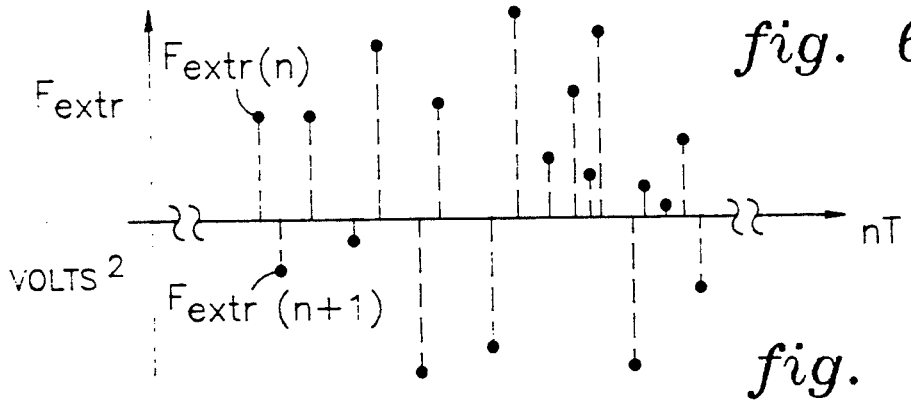

The sound signal 32 is received by the microphone 13 and provided on line 14 to the receiver circuit 15. The analog signal $S_n(t)$ is shown in FIG. 3. The incoming signal is amplified twice, in second and third gain sections 39, 40. Due to the sampling frequency of the a/d converter 41 (12-bit) and low frequency noise, the signal $S_n(t)$ is passed through a band-pass filter 42, band-limited at 5 kHz and 20 kHz. The analog received signal $S_n(t)$ is converted into a 12-bit digital form 41 and then scaled 43 to an 8-bit form. The purpose of scaling from 12-bit form to 8-bit form is to reduce the data to be evaluated.

The gain of these amplifiers is gradually increased 44 in response to the time value provided by the receiving timer 17 on a line 45. As the time passed since the trigger signal was provided increases, so does the gain of the amplifiers 39, 40. The microphone 13 is enabled on a line 52 by the trigger signal and shuts off 300 ms later. The measuring time includes analyzing time; receiving time equals 300 ms and is a part of the measuring time. The received analog signal is shown in FIG. 3. The amplified, filtered, 8-bit digital signal is provided to the time and distance detection circuit 28 on line 21.

To obtain the distance between the microphone 13 and loudspeaker 8, the time and distance detection circuit 28 applies $S_n(nT)$ to a zero-crossing detector 47, takes a cross-correlation, $R_{s_n s_r}$, between the received signal $S_n(nT)$ and an undisturbed reference signal $S_r(nT)$ obtains the extremums, takes the envelope of the extremums, obtains the travel time from the first significant peak of the envelope, and multiplies this travel time by the speed of sound. The increment of the time period T is n.

After the start 46 of the time and distance detection section 28 and the receiving of the digitized received signal $S_n(nT)$ 47, whether the receiving time is greater than or equal to 300 ms is determined 48. The receiving timer 17 is started by the trigger signal. The value 300 ms was arrived at by dividing the length of the hoistway 3, here 100 m., by the speed of sound, 331 meters/-second. Step 48, in combination with the receiving timer 17, assures that only 300 ms worth of $S_n(nT)$ will be evaluated.

In step 49, the received data is reduced to decrease the evaluation time. In step 49, the digitized received signal $S_n(nT)$ is applied to a zero-crossing detector. The zero-crossing detector takes the median frequency, $\bar{f}$, during a window nT. By taking the median frequency of a selectable period repeatedly, over an $S_n(nT)$ curve, one obtains the number of zero-crossings over the entire $S_n(nT)$. Thus, $F_{zc}$, after the zero-crossing detector, has the units of frequency as a function of time. The peak yields the time travel range where the useful signal is located. By this, the cross-correlation function between the received signal, digital, and the undisturbed reference, digital, is conducted over a shorter time range.

In step 53, there are two inputs: the reduced received digital signal $S_n(nT)$ and an undisturbed reference signal $S_n$ obtained at step 50 by the controller 12 from memory 51 on a line 52. The cross-correlation, $R_{s_n s_r}$, of these two over the shorter time range is taken. This reduces the computing overhead by 90%. The undisturbed reference signal is obtained by receiving a signal in a noiseless environment. The detection is based on the average product of the received signal and a reference function possessing some known characteristic of the transmitted wave. There are at least two ways to obtain the cross-correlation. One is that the average product can be formed, for example, by multiplying and integrating. Another is by the use of a matched filter whose impulse response, when reversed in time, is the reference function. The former method is preferred to the latter. The goal is to search for a 4.5. ms signal within the 300 ms time range. The cross-correlation function depends mainly on the frequency content and phase content and less on the amplitude. The cross-correlation function of the digitized received signal $S_n(nT)$ and $S_r(nT)$ is of the form:

$$R_{s_n s_r}(n) = \sum_{i=1}^{N} S_n(n+i)\, S_r(i)$$

In step 54, the extremums $F_{extr}$ of the cross-correlation function $R_{s_n s_r}$, $R_{extr} = \mathrm{Extr}\,(R_{s_n s_r})$, is taken.

In step 55, the envelope of the extremums is taken, $F_{env} | F_{extr}(n) - F_{extr}(n-1)$. The peaks of the envelope represent the direct signal as well as the echoes.

Figure 7:
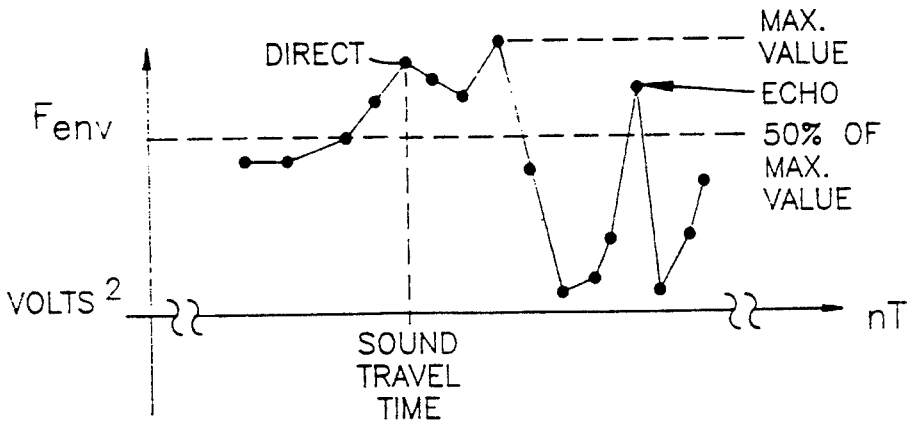

The earliest peak represents the direct signal 32 (see FIG. 7) while the later peaks represent echoes of the hoistway walls. The earliest peak is taken, step 56, as the sound travel time of the direct signal only if it is greater than 50% of the maximum value of the envelope of the extremums. If the earliest peak is less than this, it is ignored as noise. The second travel time is used to obtain the absolute position.

Then the temperature reading is obtained in step 57 from the temperature sensor 26 and provided to the time and distance detection section 28 in controller 12. The transmission speed is calculated, step 58, using the temperature.

The sound travel time depends on the sound transmission speed, C:

$$C = C_0 \cdot \sqrt{1 + \frac{\text{Temperature}}{273^\circ\ \text{C.}}}\ \text{m/s} \qquad \text{Equation 1}$$

$$\text{Distance} = \text{sound travel time} \times C$$

with $C_0$ equal to 331.45 m/s at 0° Celsius.

The distance between the microphone and loudspeaker is calculated 59 by multiplying the sound travel time by the signal velocity, which depends on the temperature of the hoistway measured with a temperature sensor 26. This done, the routine is exited, step 60.

Although the invention has been shown and described with respect to a best mode embodiment thereof, it should be understood by those skilled in the art that the foregoing and various other changes, omissions, and additions in the form and detail thereof may be made therein without departing from the spirit and scope of the invention. For example, the positions of the microphone and loudspeaker may be reversed.

Further, it is irrelevant to the invention whether the loudspeaker 8 and microphone 13 are above or below the car. The above-mentioned positioning of the loudspeaker 8 and microphone 13 shown in FIG. 1 is preferable to a positioning of one or the other on the bottom of the car and one or the other in the hoistway pit 7, because generally the controller 12 is above the top floor. Therefore, the communication line between the hoistway ceiling 4 and the controller 12 is shorter than that between the pit 7 and controller 12.

Figure 8:
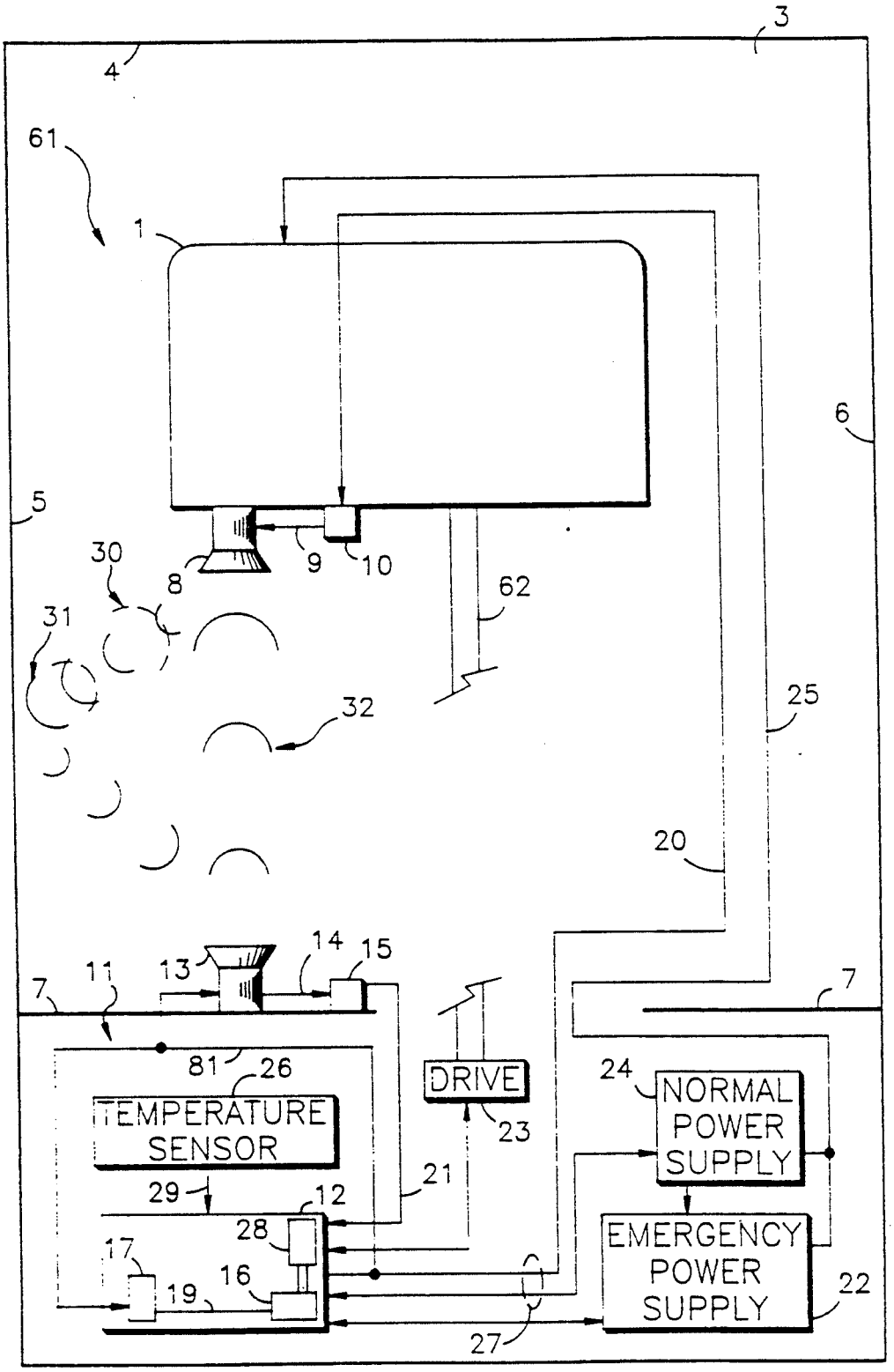
FIG. 8 shows a hydraulic elevator with the loudspeaker 8 and microphone 13 below the car 1.

For example, in a hydraulic elevator system 61 (FIG. 8) wherein the controller 12 is below the floor 7, it is desirable to place a microphone 13 on the bottom of the car 1 and a loudspeaker 8 on the floor of the hoistway 3. Associated with the microphone 8 is a receiving circuit 15, and associated with the loudspeaker 8 is a transmitting circuit 10. The hydraulic elevator is hoisted by a plunger 62.

It is similarly unimportant to the claimed invention whether the object being hoisted in the hoistway 3 (FIG. 1) is the car or a counterweight. The preferred embodiment gives absolute position of the car. Where the microphone 13 and loudspeaker 8 are mounted on the ceiling 4 and a counterweight to the car, the preferred embodiment is modified so that the distance calculation circuit adds a constant corresponding to the difference between counterweight position and the distance between an end of said hoistway and the car. In the distance calculation circuit, a table contains the appropriate constant for a given counterweight position to be added to obtain the corresponding distance between an end of said hoistway and the car. The table has two columns and an number of rows. One column contains counterweight positions, and the other column contains the constants to be added to obtain the distance between an end of said hoistway and the car. For example, when the counterweight is half-way down the hoistway, the constant is zero.

Finally, the data reduction need not be done by the scaling of a 12-bit signal to an 8-bit signal and a zero-crossing detector; other methods of data reduction may be used without detracting from the invention.

It should be understood by those skilled in the art that the foregoing and various other changes, omissions, and additions in the form and detail thereof may be made therein without departing from the spirit and scope of the invention.

We claim:

1. A method for measuring the distance of an end of a hoistway from a stationary elevator car in a hoistway, comprising the steps of:

providing an acoustic source excited with an up-sweep signal, with the boundaries of said up-sweep signal being outside the frequency of ambient acoustic noise near said microphone, for transmitting a sound signal in the audible frequency range;

providing a microphone, responsive to said sound signal;

transmitting said sound signal from said acoustic source in response to a trigger signal;

receiving said sound signal at said microphone;

measuring the time elapsed between said step of transmitting and said step of receiving said sound signal and providing a travel time signal; and calculating said distance in response to said travel time signal, including multiplying the speed of sound by said travel time signal.

2. The method of claim 1, further comprising the steps of:

cross-correlating said received signal with a reference signal and providing a cross-correlation signal; and obtaining said travel time by locating a first significant maxima of said cross-correlation signal.

3. The method of claim 1, further comprising the steps of:

measuring the temperature of the air in said hoistway and providing a temperature signal; and calculating said distance as a function of said travel time signal and said temperature signal.

4. The method of claim 1, wherein said step of transmitting occurs in response to a failure of a normal power supply.

5. An apparatus for measuring the distance of an end of a hoistway from a stationary elevator car in a hoistway, comprising:

an acoustic source excited with an up-sweep signal, with the boundaries of said up-sweep signal being outside the frequency of ambient acoustic noise near said microphone, for transmitting a sound signal in the audible frequency range;

a microphone, responsive to said sound signal;

a receiver of said sound signal at said microphone;

a timer, for measuring the time elapsed between said transmission of said sound signal and the receipt of said sound signal at said microphone, and providing a travel time signal; and calculating means, for calculating said distance in response to said travel time signal.

6. The apparatus of claim 5, further comprising:

means for cross-correlating said received signal with a reference signal and providing a cross-correlation signal; and means for obtaining said travel time by locating a first significant maxima of said cross-correlation signal.

7. The apparatus of claim 5, further comprising:

temperature sensing means for measuring the temperature of the air in said hoistway and providing a temperature signal to said calculating means, said calculating means in response to said temperature signal.

8. The apparatus of claim 5, wherein said acoustic source is operable in response to a failure of a normal power supply.

9. The apparatus of claim 5, wherein said acoustic source and said microphone are mounted beneath the elevator car.

10. The apparatus of claim 5, wherein said microphone and acoustic source are mounted above the elevator car.

* * * * *